United States Patent [19]

Nist

[11] 4,305,412

[45] Dec. 15, 1981

[54] EYELASH CURLER

[75] Inventor: Margaret E. Nist, Pasadena, Calif.

[73] Assignee: Donald E. Nist, Pasadena, Calif. ; a part interest

[21] Appl. No.: 151,425

[22] Filed: May 19, 1980

[51] Int. Cl.[3] ..... A45D 2/00

[52] U.S. Cl. ..... 132/31 A; 132/32 C

[58] Field of Search ..... 132/31 A, 32 C

[56] References Cited

U.S. PATENT DOCUMENTS

| | | | |
|---|---|---|---|
| 2,569,246 | 9/1951 | Marcellus | 132/32 C |
| 2,602,458 | 7/1952 | Tuttle et al. | 132/32 C |
| 2,893,404 | 7/1959 | Flynn | 132/32 C |
| 3,838,699 | 10/1974 | Skandalakis | 132/31 A |

*Primary Examiner*—G. E. McNeill

*Attorney, Agent, or Firm*—Donald E. Nist

[57] ABSTRACT

The improved eyelash curler of the present invention comprises a blade, a pad, support means holding the pad substantially horizontally below the substantially horizontal blade and means for vertically controllably opposing the pad and blade to curl eyelashes therebetween. The surface of the blade and/or pad which contacts the eyelashes during curling thereof is substantially curved and/or sloped from the horizontal to impart varying degrees of curl to various portions of the eyelashes for an improved natural appearance. The pad and/or blade can be made removable from the curler and, preferably, reversible. The curler may, if desired, be adapted for primary use for one eye, specifically the eyelashes of the upper lid of one eye, and a pair of such curlers can be used, one for each eye. The curler is simple, inexpensive and effective.

14 Claims, 8 Drawing Figures

EYELASH CURLER

BACKGROUND OF THE INVENTION

1. Field of the Invention

The present invention generally relates to curling means and more particularly to an improved type of eyelash curler.

2. Prior Art

Conventional eyelash curlers usually comprise a metal scissors-like instrument having a frame bearing a horizontally disposed metal or plastic blade contoured to the eye, and a contoured rubber or plastic pad horizontally disposed below the blade on a contoured platform slideably received on the frame. The frame and platform are connected to crossed and pivoted handles so that the platform and pad can be slid towards and away from the blade by manipulation of the handles. When it is desired to use the curler, the blade is placed above the eyelashes of the upper eyelid and then those eyelashes are pinched between the converging pad and blade to bend, lift and curl them upwardly, thereby enhancing the beauty of the eye by making it appear larger and more open.

Unfortunately, conventional eyelash curlers generally fail to accomplish the curling in a desirable manner. One of the problems is that such instruments are designed to be used interchangeably for both the right and the left eye. For such purposes, the lower edge of the blade and the upper surface of the pad are made substantially parallel. Usually the upper surface of the pad is horizontal and the lower edge of the blade is either horizontal or very very slightly uniformly curved with the center fractionally higher than the sides thereof.

The curling pressure that can be exerted on the eyelashes with such an instrument is substantially the same for all of eyelashes, including those at the inner and outer margins of the eyelid. The visual results obtained by using such an instrument are undesirable in that the eyelashes look squared off and artificial, both when viewed from the front and also from the side. In particular, the eyelashes at the outer margin of the eyelid have substantially the same degree of curl and curl angle as the other eyelashes.

Pads of polytetrafluoroethylene and silicone rubber have been used on the curler platform in an attempt to overcome these deficiencies but have failed. Eyelashes curled with instruments containing such pads still appear squared off. Moreover, much greater pressure must be applied by the instrument, especially if the pad is hard, than the average user desires to exert in order to get any curl at all. The individual eyelashes also tend to stick to soft rubber and plastic pads or to the opposing blade, causing the lashes to be inadvertently pulled out and lost. This situation is particularly prevalent when the soft pad becomes damaged by the application of too much pressure, when used for too long a period of time or when the leading edge of the opposing blade is too sharp, so that the pad becomes indented by the blade, forming a narrow crevice. When the blade passes into this crevice, the eyelashes trapped therein are sharply bent and pulled out.

Another difficulty of conventional eyelash curlers is that they are not adapted for use with the wide variety of sizes, shapes and placement of human eyes, eyelids and eyelashes which are normally encountered. Even a given user may need to vary her eye appearance, depending on her mode of dress, hair arrangement, etc.

Eyelash curling variations of this nature cannot be made with conventional eyelash curlers having substantially parallel opposing curling surfaces.

Accordingly, there is a need for improved means for assuring variable, natural, individual, non-stick, non-pulling, graceful curling of each eyelash area, with complete control by the user of the effect to be created. Such an eyelash curler should be capable of operating efficiently when only gentle pressure is applied thereby.

SUMMARY OF THE INVENTION

The improved eyelash curler of the present invention satisfies all the foregoing needs. The curler is substantially as set forth in the Abstract above. The proper curling of the eyelashes is achieved through the use of a blade and pad, the opposing surfaces of which are substantially non-parallel. When light curling pressure is applied by the instrument to the eyelashes, such curling pressure varies in a predetermined manner from eyelash area to eyelash area to create an entirely natural and controlled effect. With this effect, the eyelashes at the outer margin of the upper eyelid are usually caused to curl and slope upwardly and sideways, not just straight up, as when conventional curlers are used.

In order to achieve the desired effect, the edge of the blade and/or the edge of the pad which contacts the eyelashes is substantially sloped and/or curved rather than being substantially horizontal. Preferably, the blade and/or pad is removable and most preferably is also reversible to permit a maximum of adaptation to the individual contour needs of the user. Alternatively, separate curlers for the right upper eyelid and the left upper eyelid can be used, which curlers can, if desired, be mirror images of each other. The handles, blades or other portions of the curlers can be color coded or otherwise marked with indicia to indicate which curler is for which eye. In some instances, due to the slant of the upper lids, length and alignment of eyelashes and/or other facial characteristics, it may be desirable to reverse the separate curlers.

The improved eyelash curler is compact, simple, inexpensive and efficient. It curls eyelashes more naturally for substantially improved appearance. The curler's pad and blade preferably can be removed (and reversed, if desired) and substituted for by other pads and blades of different curvature and/or slope to permit maximum adjustment of the curlers to individual needs. Further features of the invention are set forth in the following detailed description and accompanying drawings.

DRAWINGS

DETAILED DESCRIPTION

FIGS. 1–3

Figure 1:
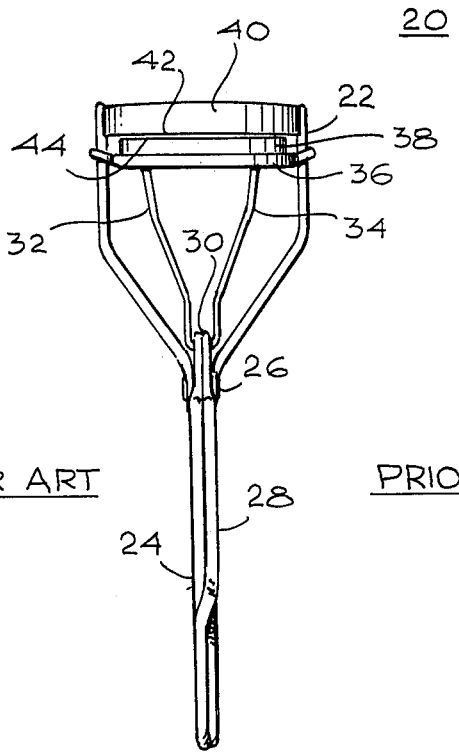
PRIOR ART Fig. 1
FIG. 1 is a schematic front elevation of a conventional eyelash curler.
Figure 2:
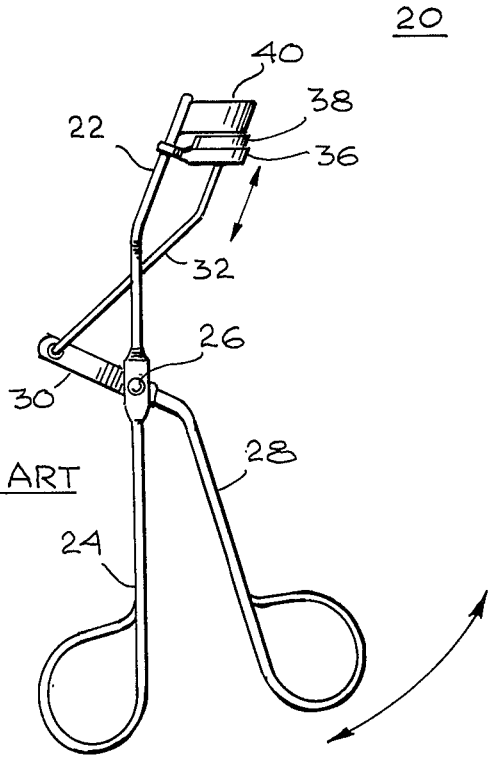
PRIOR ART Fig. 2
FIG. 2 is a schematic side elevation of the curler of FIG. 1.
Figure 3:
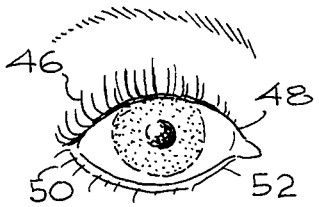
PRIOR ART Fig. 3
FIG. 3 is a schematic front elevation of a human eye, depicting the upper eyelashes after curling with the curler of FIG. 1.

A conventional eyelash curler, such as is currently being marked, is schematically depicted in FIGS. 1–3. Such a curler 20 includes an upper metal or plastic frame 22 integral with a lower metal or plastic handle 24 which is pivotally secured, as at point 26, to a second metal or plastic handle 28 to form a scissors-like configuration. The upper end 30 of handle 28 is secured to an upwardly extending pair of metal or plastic support arms 32 and 34 bearing a horizontal metal or plastic platform 36 in turn supporting a resilient synthetic or natural rubber or plastic pad 38 at its upper end.

Platform 36 is slideably secured to frame 22 and is disposed below a horizontal metal or plastic blade 40 permanently secured in frame 22. Pad 38, platform 36 and blade 40 are contoured and curved in the horizontal plane to conform to the about spherical bulge of the human eye and eyelids. The opposing edge 42 of blade 40 and upper opposing surface 44 of pad 38 are essential horizontal, parallel and symmetrical.

Curler 20 normally is only applied to the eyelashes 46 of each upper eyelid 48 (FIG. 3). The eyelashes 50 of the lower eyelids 52 are usually not curled by curler 20, since they are thin and short and naturally curl down in any event. Moreover, they present no visual impact. FIG. 3 shows that curler 20 bends, curls and reflects substantially all of eyelashes 46 up to the same or nearly the same extent. This includes eyelashes 46 at the inner and outer margins of eyelid 48 as well as those therebetween, that is, in the central portion of eyelid 48. The result is an entirely unnatural look. The marginal eyelashes 46 should not bend sharply up for a natural appearance, but instead, bend both sideways and up. Moreover, arms 32 and 34 are spaced wide enough to cause the central portion of platform 36 to reflect downwardly as blade 40 and pad 38 press against eyelashes 46, thereby increasing the relative crimping force exerted on those marginal eyelashes 46 to further exaggerate the unnatural effect.

FIG. 4

Figure 4:
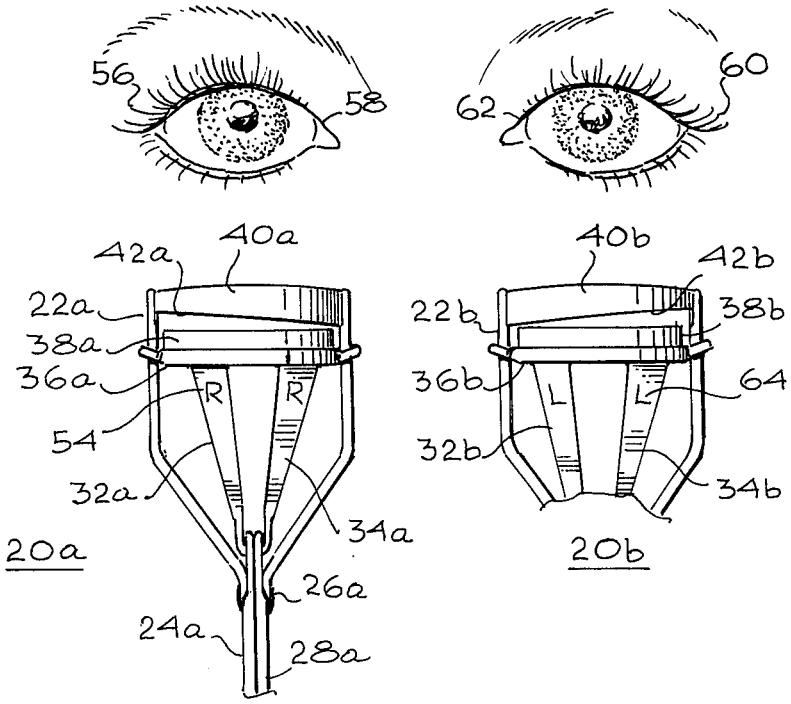
FIG. 4 is a schematic front elevation, partly broken away, of a first preferred embodiment of the improved eyelash curler of the present invention, depicting a matching pair of the curlers disposed below the eyelashes curled thereby.

A first preferred embodiment of the improved eyelash curler of the present invention is schematically depicted in FIG. 4. Components thereof similar to those of curler 20 bear the same numerals but are succeeded by the letter "a" for one version shown therein and the letter "b" for the other version shown therein. Those versions are mirror images of each other.

Thus, curler **20*a* has a frame 22*a*, handles 24*a* and 28*a* pivotally interconnected at point 26*a* to provide a scissors-like configuration, arms 32*a* and 34*a*, platform 36*a*, pad 38*a* and blade 40*a*. However, arms 32*a* and 34*a* are thicker and placed closer together than arms 32 and 34, so as to stabilize platform 36*a* against bending during curling. Moreover, edge 42*a* of blade 40*a* is sloped from end to end (side to side) rather than horizontal. In addition, indicia 54 designate curler 20*a* as R, that is, for the right eye, while curler 20*b* depicted in FIG. 4 is designated L, that is, for the left eye, by indicia 64**.

It will be noted that the upper lid eyelashes 56 of the right eye when curled with curler **20*a* provide an entirely natural open eyed, large eyed appearance. Eyelashes 56 which are at the outer margin of eyelid 58 slant sideways as well as upwardly. This is because of the lower degree of upward bending pressure exerted by edge 42*a* thereon, since edge 42*a* slopes up from the inner margin to the outer margin thereof in curler 20*a*. Curler 20*b* achieves the same results with eyelashes 60 of the left upper eyelid 62 by having edge 42*b* of blade 40*b* slope up from the inner to the outer margin thereof. Curlers 20*a* and 20*b*** are effective, simple and inexpensive.

FIG. 5

Figure 5:
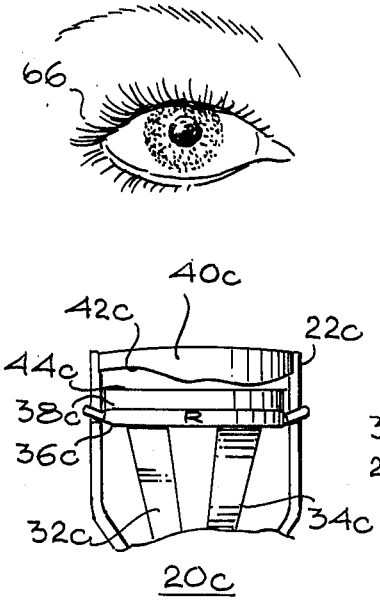
FIG. 5 is a schematic front elevation, partly broken away, of a second preferred embodiment of the improved eyelash curler of the present invention, showing a matching pair of the curlers disposed below the eyelashes curled thereby.
Figure 5:
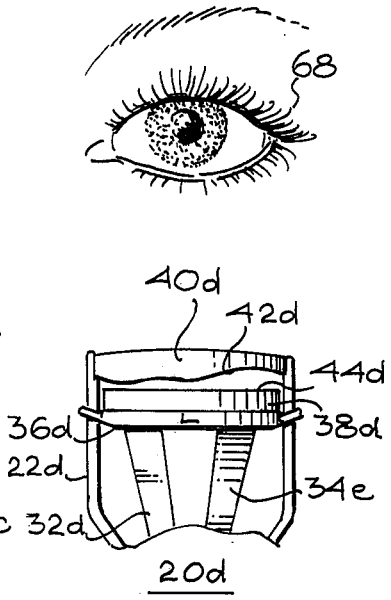

A second preferred embodiment of the improved eyelash curler of the present invention is schematically depicted in FIG. 5. Thus, curlers **20*c* and 20*d* are shown which are marked, respectively, "R" and "L" for "right eye" and "left eye" and which provide results similar to those provided by curlers 20*a* and 20*b***.

Curlers **20*c* and 20*d* are substantially identical to curlers 20*a* and 20*b*, except that the edges 42*c* and 42*d* of, respectively, blades 40*c* and 40*d* are curved upwardly, rather than sloped upwardly, from the inner to the outer margins thereof in a predetermined multi-curved manner to provide optimal curling for eyelashes 66 and 68 of the right and left upper eyelids, respectively, as shown in FIG. 5. As with curlers 20*a* and 20*b*, the upper surfaces 44*c* and 44*d* of pads 38*c* and 38*d*** are flat and horizontal.

FIG. 6.

Figure 6:
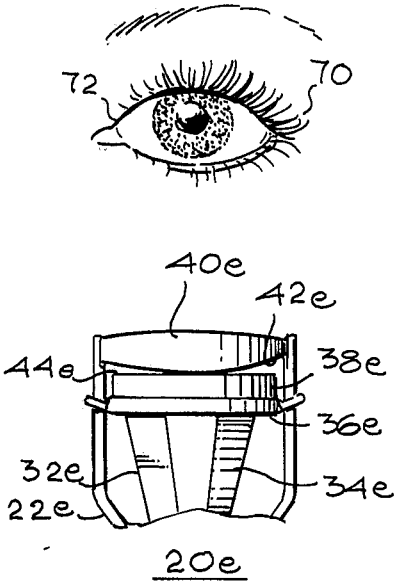
FIG. 6 is a schematic front elevation, partly broken away, of a third prerred embodiment of the improved eyelash curler of the present invention, showing the curler below eyelashes curled thereby.

A third preferred embodiment of the improved eyelash curler of the present invention is schematically depicted in FIG. 6. Thus, single curler **20*e* is shown which is substantially identical to curlers 20*a*, 20*b*, 20*c* and 20*d*, except that edge 42*e* of blade 40*e* is regularly and arcuately curved, so that the center portion depends further down toward horizontal pad 38*e* and its upper horizontal surface 44*e* than do the margins of edge 42*e***.

Using curler **20*e*, it is possible to curl eyelashes 70 of upper eyelid 72 of either eye with equal facility, in each case marginal eyelashes 70 being curled to a lesser degree than central eyelashes 70**, so as to provide a more natural effect.

FIGS. 7–8

Figure 7:
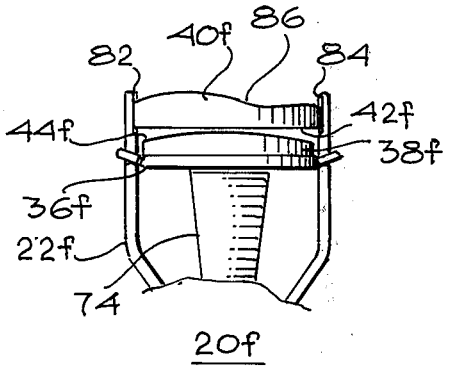
FIG. 7 is a schematic front elevation, partly broken away, of a fourth preferred embodiment of the improved eyelash curler of the present invention with a removable reversible blade; and, FIG. 8 is a schematic front elevation, partly broken away, of three removable and reversible pads utilizable in the curler of FIG. 7.

A fourth preferred embodiment of the improved eyelash curler of the present invention is schematically depicted in FIG. 7. Thus, curler **20*f* is shown, substantially identical to curlers 20*a, b, c, d* and *e*, except that upper surface 44*f* of pad 38*f* is regularly and arcuately curved, with the central portion thereof above the margins thereof. Moreover, edge 42*f* of blade 40*f* is straight and horizontal. A single wide thick central arm 74 is used in place of arms 32*e* and 34*e* of curler 20*e*. Essentially the same curling results are obtained as with curler 20*e***.

Figure 8:
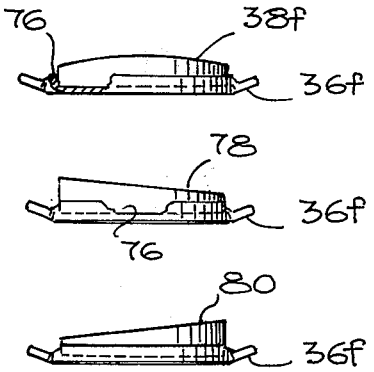

Pad 38*f* is removable from a pocket 76 (FIG. 8) and can be substituted for by sloped pads 78 and 80 shown in FIG. 8. Moreover, if desired, pad 78 can be reversed, end to end, to in effect serve as pad 80.

Blade 40*f* can also be made reversible and invertable. Thus, the ends of blade 40*f* can be releasably disposed in pockets 82 and 84. Blade 40*f* can be made flexible enough so as to be able to remove it by flexing from pockets 82 and 84. Since the upper edge 86 of blade 40*f* is multi-curved, it can be used as the edge opposing pad 38*f* merely by inverting blade 40*f*, and reversing ends thereof, if desired, and then reinserting it into pockets 82 and 84.

Accordingly, curler 20*f* offers a maximum number of selective combinations of curves and slopes by means of pads 38*f*, 78 and 80 and edges 42*f* and 86 of blade 40*f* so as to effectively customize curler 20*f* to meet every eyelash curling need of the individual user.

Various other features of the invention are as set forth in the foregoing. Various modifications, changes, alterations and additions can be made in the improved eyelash curler of the present invention and in its components and their parameters. All such modifications, changes, alterations and additions as are within the scope of the appended claims form part of the present invention.

It will be understood that the slopes and curves of the opposing surfaces of the novel blades and pads described herein have been exaggerated in the drawings solely for purposes of illustration.

What is claimed is:

1. An improved eyelash curler, said curler comprising, in combination:

a. a blade;

b. a first support means holding said blade in an about horizontal plane;

c. a pad;

d. a second support means releasably bearing said pad adjacent the upper surface thereof in an about horizontal plane below said blade; and e. means for vertically controllably opposing said blade and pad to curl eyelashes therebetween, the opposing eyelash-contacting surfaces of said blade and pad being non-parallel to each other, at least one of said opposing surfaces being either substantially curved and/or substantially sloped from said horizontal plane to cause said opposing surfaces to impart varying degrees of curl to various portions of said eyelashes for an improved natural appearance.

2. The improved eyelash curler of claim 1 wherein the lower eyelash-contacting surface of said blade is sloped substantially from the horizontal.

3. The improved eyelash curler of claim 2 wherein said blade is removable from said first support means.

4. The improved eyelash curler of claim 3 wherein said removable blade is reversible.

5. The improved eyelash curler of claim 2 wherein the upper eyelash-contacting surface of said pad is substantially horizontal.

6. The improved eyelash curler of claim 1 wherein the lower eyelash-contacting surface of said blade is substantially curved downwardly.

7. The improved eyelash curler of claim 1 wherein the upper eyelash-contacting surface of said pad is sloped substantially from the horizontal.

8. The improved eyelash curler of claim 7 wherein said pad is removable from said second support means.

9. The improved eyelash curler of claim 8 wherein said pad is reversible.

10. The improved eyelash curler of claim 7 wherein the lower eyelash-contacting surface of said blade is substantially horizontal.

11. The improved eyelash curler of claim 1 wherein the upper eyelash-contacting surface of said pad is substantially curved upwardly from the horizontal.

12. The improved eyelash curler of claim 5 wherein said curler bears indicia indicating to what eyelashes of which eye said curler is to be applied.

13. The improved eyelash curler of claim 1 wherein said curler includes a plurality of said pads and/or blades of differing slopes and/or curves releasably disposable in said support means.

14. The improved eyelash curler of claim 1 wherein said means for controllably opposing said blade and pad comprises a pair of crossed handles pivoted to each other in scissor-like configuration, one of said handles bearing said frame at its upper end and the other of said handles bearing said platform at its upper end, said platform being braced sufficiently at its center portion to prevent its downward deflection during eyelash curling and excessive curling of eyelashes at the margins of an eyelid.

* * * * *